US005868066A

United States Patent [19]

Maher

[11] Patent Number: 5,868,066

[45] Date of Patent: Feb. 9, 1999

[54] CONTAINER AND BALING DEVICE FOR PAPER AND OTHER FLAT STOCK

[76] Inventor: David Frank Maher, 1160 Brittany Ct. #99, Neenah, Wis. 54956

[21] Appl. No.: 697,581

[22] Filed: Aug. 27, 1996

[51] Int. Cl.[6] ..... B65B 27/08

[52] U.S. Cl. ..... 100/34; 211/50; D6/475

[58] Field of Search ..... 100/1, 34; 211/50; D6/458, 462, 475; D3/306, 307

[56] References Cited

U.S. PATENT DOCUMENTS

| | | | |
|---|---|---|---|
| D. 247,207 | 2/1978 | Moynihan | D6/462 |
| D. 284,916 | 8/1986 | Marks | D6/462 |
| D. 330,130 | 10/1992 | Evans | D6/475 |
| D. 336,801 | 6/1993 | Ossenfort | D6/458 |
| 1,882,343 | 10/1932 | Troth | 100/34 |
| 3,171,347 | 3/1965 | Elrod | 100/34 |
| 3,826,186 | 7/1974 | Mechler | 100/34 |
| 4,104,960 | 8/1978 | Kuhnan | 100/34 |
| 4,167,903 | 9/1979 | Lasher | 100/34 |
| 4,941,653 | 7/1990 | Sterner, Jr. | 100/34 |
| 5,072,576 | 12/1991 | Evans | 100/34 |
| 5,114,020 | 5/1992 | Martin | 100/34 |
| 5,388,506 | 2/1995 | Vargas et al. | 100/34 |
| 5,586,493 | 12/1996 | McEntree | 100/34 |

*Primary Examiner*—Stephen F. Gerrity

[57] ABSTRACT

A containing and baling device for paper, paper board or any other flat stock that is being contained for binding and baling purposes. The invention both, contains and obscures the flat stock material and allows for the easy binding or baling using the human arms and hands, or a tool equivalent, to transport or pass the binding medium under and around the flat stock without in any way lifting, moving or removing it from the container during the binding and baling operation. The bound bales are removed from the invention and the device can be reused indefinitely. The invention utilizes one of three lid designs. The lid functions to both further obscure the flat stock accumulation and offer a utilitarian horizontal surface so that the invention can be used as a work surface or as a furniture item such as an end table or coffee table in the closed position. The device is designed so that paper or flat-stock products can be introduced into the device with the lids in the closed position.

15 Claims, 8 Drawing Sheets

17
19
24
25
16
18
05
SL4
24
7
6
SL3
8
25
9
04
03
5
SL1
SL2
1
10
4
01
3
SL4
23
SL3
2
02
20
22
SL1
21
SL2
11
12
14
15
13

CONTAINER AND BALING DEVICE FOR PAPER AND OTHER FLAT STOCK

BACKGROUND OF THE INVENTION

This invention relates to a common problem that exists in the majority of homes and businesses in the United States; paper and other types of flat-stock are produced or accumulate through use, such as in production, the production of documents, waste or simply the accumulation of used papers, newspapers and magazines. The storing of this accumulated flat-stock, for the purposes of distribution, disposal or, more commonly, recycling presents a problem when the stored material must be moved. If the material has not been stored in a container of some sort, it has undoubtedly slid into a slump pile and must be gathered, organized and bundled or baled in some fashion to be acceptable to those who must move it. If the material has been stored in a container of some sort, then it either has to be moved from the container in order to then be bundled or baled or the container, itself, must be used as part of the moving process. In many instances this may add an unjustifiable expense and, in the case of recycling, add an unacceptable material to the recycling effort. Moving the material from the container, in order to bundle or bale it, is often the only choice available and this can be cumbersome, time consuming and messy.

The invention is a device that is both a rigid container for the flat-stock, holding the accumulation in a neat stack, and then once filled, functions as a baling device, allowing for the easy and secure binding and baling of the accumulation without lifting or moving it from the device in any way. The resultant bales are securely bound and easily removed from the device so that it can be filled again and another bale bound. The device can be made as a decorative furniture item, so that it can be part of any furniture decor and thus be immediately accessible for storing and obscuring used reading material or other flat-stock until it is time to bind and bale the accumulation for disposal or recycling. The device with its rigid support system transfers the flat stock load directly to the base. The invention also incorporate one of three lid designs. When in use the lids serve to both obscure the flat stock material and provide a flat horizontal usable surface. When in the open position the lids provide of access to and binding and baling of the contained paper or flat-stock material The device may also be made in a utilitarian mode, more acceptable in basements, plants, garages, mud rooms, store rooms, closets etc., but still holds the accumulation in a stack and allows for the easy binding and baling and removal when appropriate.

SUMMARY OF INVENTION

The principal object of this invention is to provide a rigid container, for paper and other flat-stock, that also serves as a hand baling device. This rigid container has openings in each of the four rigid sides beneath a raised rigid platform. The raised rigid platform serves to support the flat stock above the bottom of the container. The openings are large enough to allow entrance by a human arm and hand, or the tool equivalent, in order to reach through and pass the binding material from one hand to the other, underneath the stored flat stock, without using sight as a guide. The openings are directly below the platform which is, itself, divided across its two centerlines, this division results in the formation of four individual platform panels that are separated by narrow slots.

These slots are contiguous with the openings directly below them. The slots in the platform are contiguous with those in the sides of the container, effectively dividing the container into four parts, separated by slots and openings but held in place relative to each other by a single unifying base with its bracing. Each of these four container divisions are braced by upwardly diagonal supports that do not intrude upon either the openings or the slots. The diagonal supports effectively transfer the load, that of the contained paper or flat stock that rests on the platform panels, directly to the base of the container. The rigid sides are made smooth either through the use of smooth solid material or the use of smooth liners inside of a strut or grid formed open cell container structure. This arrangement allows for the unimpeded hand binding, baling and easy removal of the flat-stock contained without removing the flat-stock from the container or having to lift or move the flat-stock to pass the binding medium under and around it. The binding and resulting bale remains free and unattached from the invention and because of the smooth lining is easily pulled from the invention using the binding medium as a handle.

The binding operation can be accomplished by the sense of touch alone. The openings and slots guide the user's hands and the binding medium.

The user ties or fixes the binding medium on the exposed and easily accessible top of the flat-stock. This is done in two directions at right angles to each other. The, then, bound paper or flat-stock bales can be easily removed from the container by simply lifting up using the binding medium as a handle and pulling the bale from the container. The container may now be reused to fill and store more flat-stock for baling.

The addition of any one of the three lid designs allows the device to have a utilitarian horizontal surface, and so may be used as a work surface or as a furniture item while also serving to further obscure the accumulated flat-stock. The lid(s) allow the introduction of flat-stock while in the closed position by free spanning a lowered lip on the front side of the device. In the open position the openings or position of the lids cooperate with the openings in the sidewalls of the device to allow for the unencumbered binding and baling of the contained paper or flat-stock material. The device may be of any size. The basic dimensions will be determined by the size and type of the flat-stock for which the device will be used. For example, the size of the device used to hold new flat-stock which is uniformly cut may be one percent or larger in its inside dimensions than the flatstock itself.

For flat-stock that is more irregular or perhaps composed of waste flat-stock, intended for disposal or recycling, the inside dimensions of the invention may be two percent to more than twenty percent larger than the flat-stock itself to work most effectively.

DETAILED DESCRIPTION OF THE DRAWINGS

Preferred Embodiment 1

Figure 1:
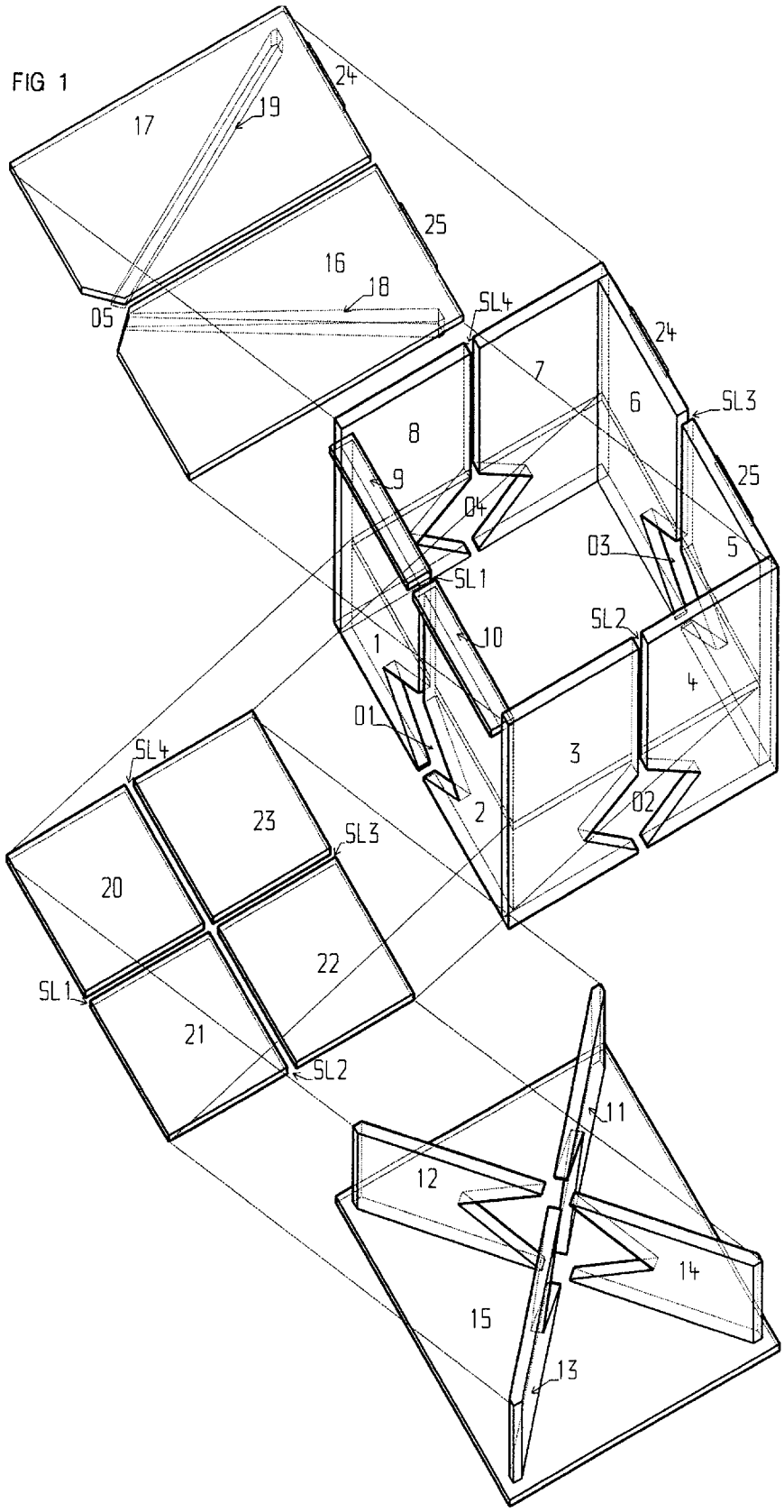
FIG. 1 is an exploded view of a first embodiment of the baling and binding container of the present invention.

FIG. 1 is an axonimetric exploded drawing of the invention. The exterior sides 1, 2, 3, 4, 5, 6, 7 and 8 are rigidly fixed to each other at the comers, the platforms (20, 21, 22 and 23) and the diagonals, (11, 12, 13 and 14), and base (15). The axonimetric shows the positions of openings (O1, O2, O3 and O4) with slots (SL1, SL2, SL3 and SL4) aligned contiguously above their respective openings. These slots may be as narrow as ⅛" or as wide as needed to accommodate the binding material and the sag potential of the flat stock Optimally, the slots may be ½ inch in width.

Members 9 and 10 serve as a lowered front lip and allow the introduction of flat-stock into the container when a top ( 16,17,18 and 19) is used and in place. The divided platform panels, themselves, (20,21,22 and 23) are held above the openings by the base and diagonal supports (11, 12, 13 and 14). The slots between the four platform panel sections (SL1, SL2, SL3 and SL4) line up with the slots in the exterior container (FIG. 1 using the same numbers).

Rigid diagonal supports (11, 12, 13 and 14) are notched and firmly attached to base 15 and transfer the load of the flat-stock held by platform panels (20, 21, 22 and 23 ) to the base and the floor or ground beneath and also allow for the contiguous passage of the binding medium through them in both directions. Preferred embodiment 1 is the simplest of the embodiments and presupposes the use of a material that is both rigid enough and strong enough to absorb and transfer the flat-stock loads and also to be firmly fixed to its adjacent parts without the use of lateral or further diagonal bracing. These materials may include, but are not limited to wood, metal, stone, plastic, rubber, fiberglass, carbon fiber composites, resin composites or other natural or man made materials that possess the strength and rigidity to carry and transfer the load of the flat-stock to the base of the unit and then to the floor or ground.

The lid shown in FIG. 1 may be made of any material that meets the decorative and/or functional needs of the user. The lid is a divided type with each of the two halves individually hinged to open independently of each other and connected by hinge elements 24 on lid 17 and 25 on lid 16 to sides 6 and 5 respectively. The fronts of the divided lids are notched so that when in the open position with 17 resting against side 6, and 16 resting against side 5, opening O5 does not obstruct opening O3. This allows for the passage of the binding medium from hand to hand through the open lid for baling of the flat stock Diagonal cantilevers 18 and 19 are notched and serve to support the inside corners of the two lids when closed and in use. The back outside corners of these cantilever supports come to bear at the comers made by sides 7 with 6 and 5 with 4 respectively. The particular lid design allows for the introduction of flat-stock into the device with the lids in the closed position.

Preferred Embodiment 1

Figure 2:
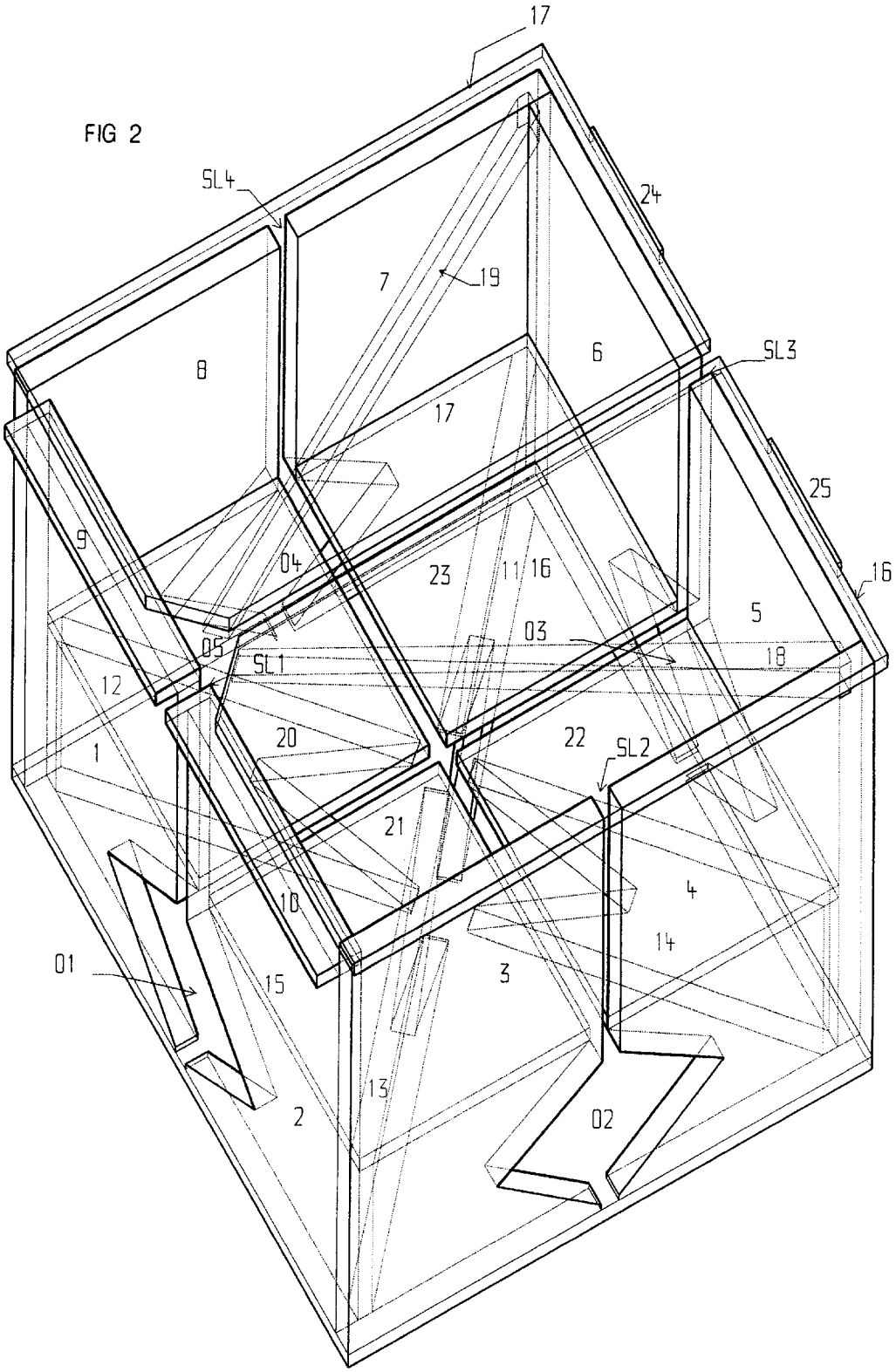
FIG. 2 is a view of the first embodiment shown in FIG. 1 in assembled form.

FIG. 2 shows the invention as an assembled unit with hidden lines shown as dashed and the hinged lid in the closed position and rendered transparent. The numbers correspond to numbers of FIG.1, Sheet 1 of 8, exploded view. Those numbers in bold face correspond to parts that are normally visible in this axonimetric view and the numbers in light face correspond to those parts that are normally hidden in this axonimetric view.

Preferred Embodiment 2

Figure 3:
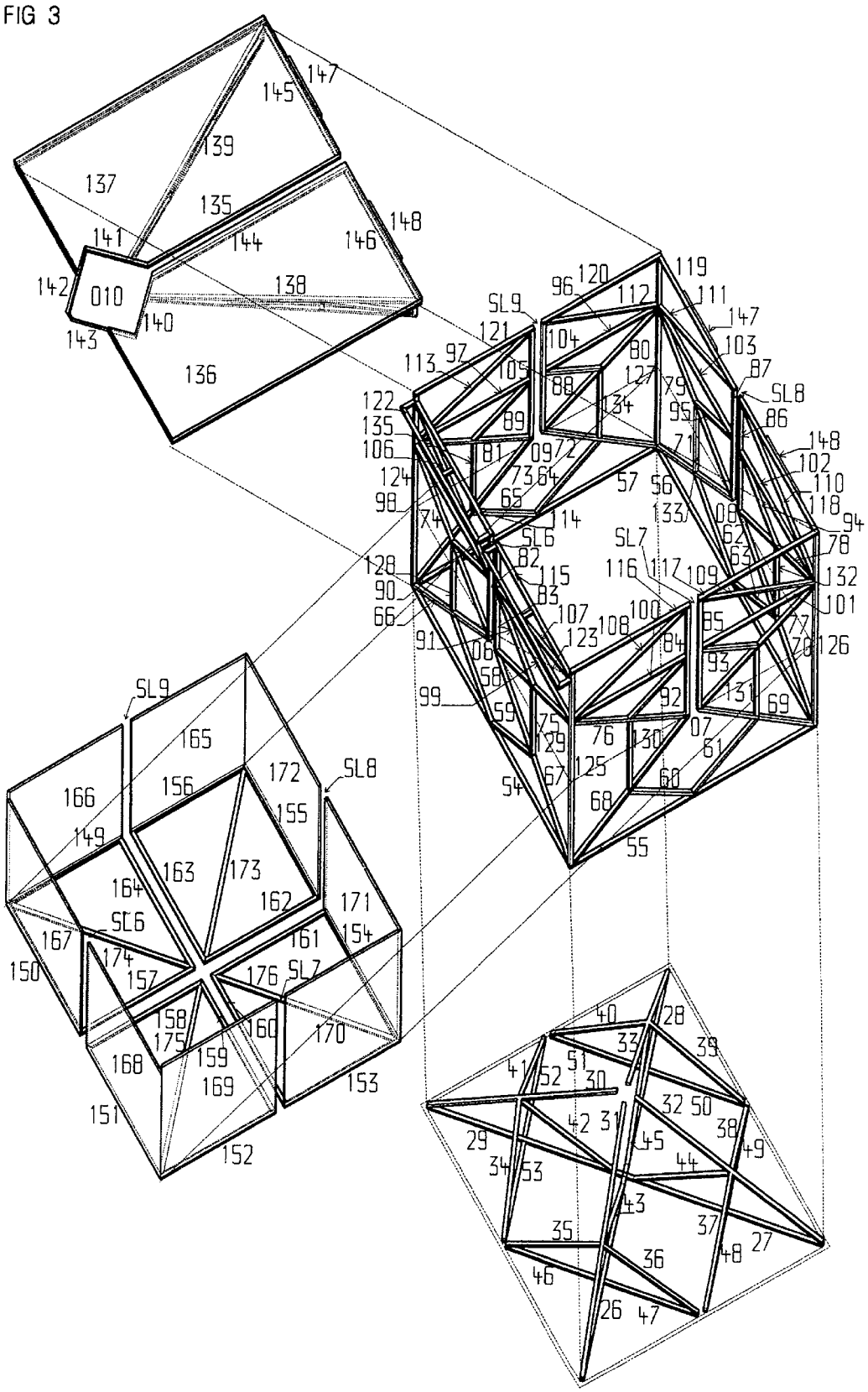
FIG. 3 is an exploded view of a second embodiment of the baling and binding container of the present invention.

FIG. 3 is an exploded view of embodiment 2. The device consists of strut like members forming a rigid base from members 26 through 53 which supports elevated platforms and smooth containing walls formed from members 149 through 176. Slots SL6, SL7, SL8 and SL9 align with the slots of the same numbers from the exterior containment box as formed by members 54 through 135. Slot SL6 is directly above opening O6 formed by members 58,59,67 and 66. Opening O6 is aligned with a notch formed in the base by members 43, 31, 42, 30, 34 and 35 and Opening O8 formed by side wall members 62, 63, 71, 78 and base members 39,38, 32 and 33. Slot SL7 is formed by members 84 and 85 and is directly above opening O7 formed by members 60,61,69 and 76. Opening O7 is aligned with a notch formed by base members 36,37,43,44,31 and 32 and is contiguous with opening O9 formed by members 64,65,72 and 73 directly below slot SL9 formed by members 88 and 89. Opening O9 is aligned with the notch formed in the base by members 304,41, 30 and 33.

Solid lid top 136 is formed by members 138,146,144,140, 143 with hinge 148 attached to member 146. Solid lid 136 is connected along its front edge where member 143 connects with member 142 to form a single action lid divided along its centerline by members 135 and 144 which form a slot that is contiguous with slot SL8 in the side walls and with opening O10 formed by members 140,141,142 and 143. Diagonal supports 138 and 139 may be utilized to further support the connected lid halves if made necessary by the lack of stiffness in the materials used for construction.

Preferred Embodiment 3

Figure 4:
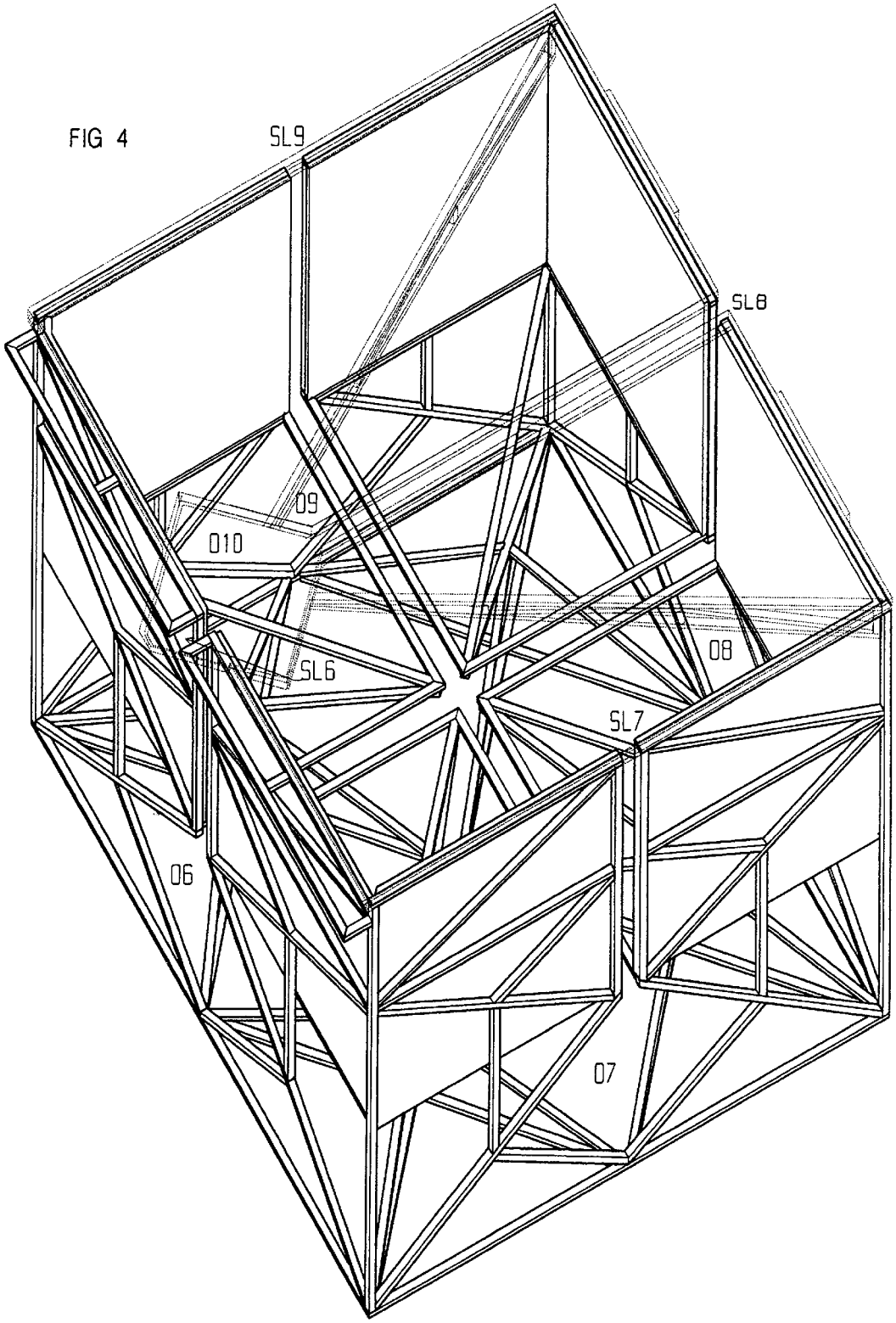
FIG. 4 is a view of the second embodiment shown in FIG. 3 in assembled form.

FIG. 4 is an enlarged view of the assembled device. Slots SL6, SL7, SL8 and SL9 are shown for orientation. Likewise openings O6, O7, O8 and O9 are shown below their respective slots. The lid(s) are shown in the closed position and are rendered transparent in this drawing to show the structure beneath.

Preferred Embodiment 3

Figure 5:
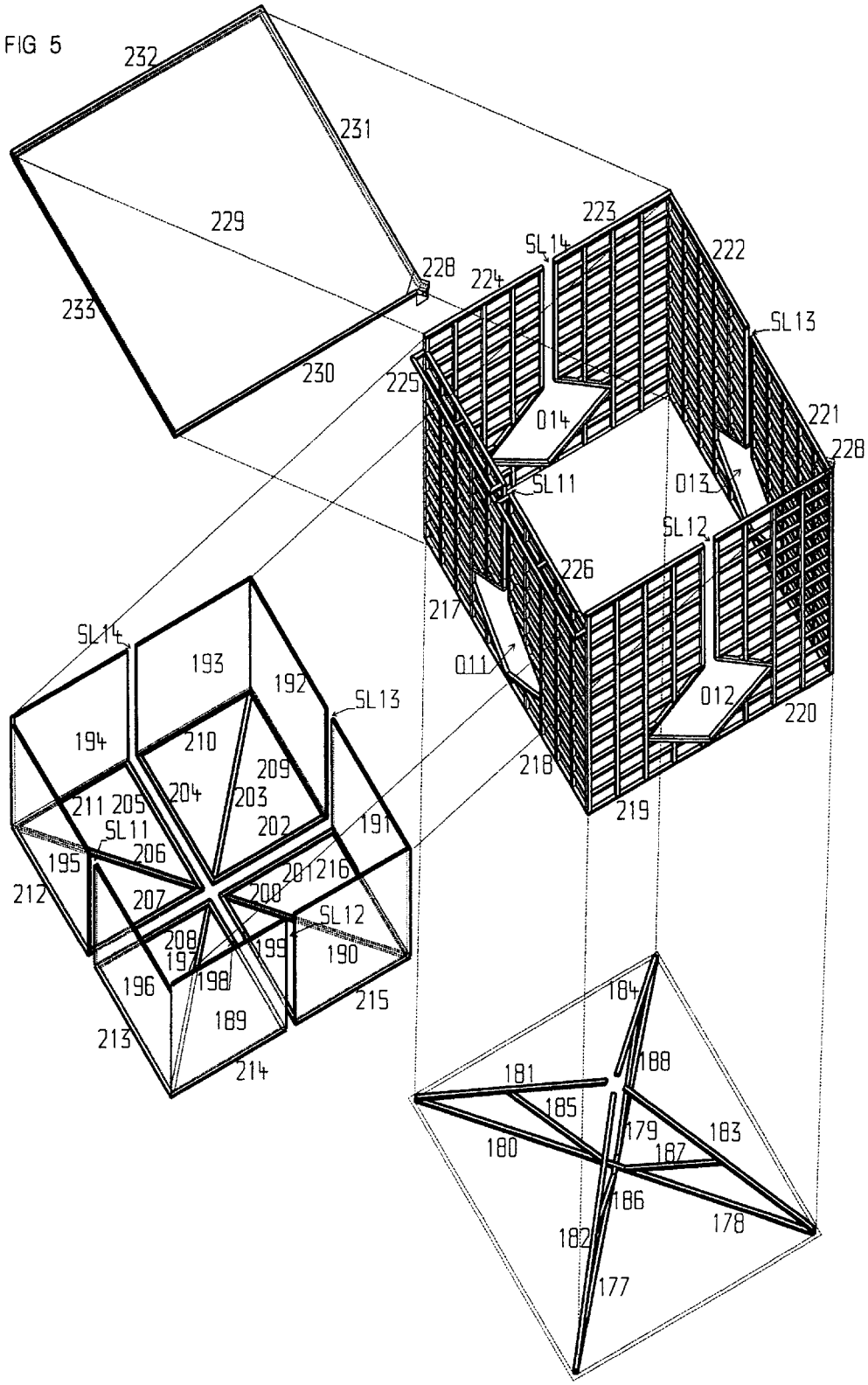
FIG. 5 is an exploded view of a third embodiment of the baling and binding container of the present invention.

FIG. 5 is an exploded axonimetric view of the third embodiment of the invention. Side walls 217, 218, 219, 220 221, 222, 223 and 224 consist of a rigid mesh type material divided as with the other embodiments with openings numbered O11, O12, O13, and O14 above which slots SL11, SL12, SL13, and SL14 are directly aligned. Liners 189, 190, 191, 192, 193, 194 and reduced height liners 195 & 196 are supported by the divided horizontal platforms formed by members 197 through 208 with horizontal members 206, 197, 200 and 203 aligning with upwardly diagonal base support members 181, 182, 183 and 184 respectively. Solid lid 229 is shown with edges 231, and 230 ending in corner hinge 228. Hinge 228 also shown in place connecting sides 220 and 221. Corner hinge 228 allows solid lid 229 to be used as a resting or work surface when in the closed position and in the open position allows the lid to swing away and rest at tangent to the comer of the device whereby the openings and slots above remain clear of the introduction of the binding medium under and around the contained paper or flat-stock for baling. Lower lips 225 and 226 allow for the introduction of flat-stock into the device with the lid in the closed position.

Members 177 through 187 serve to form the base and the support for the four horizontal platforms that in-turn hold the paper or flat-stock above the base.

Figure 6:
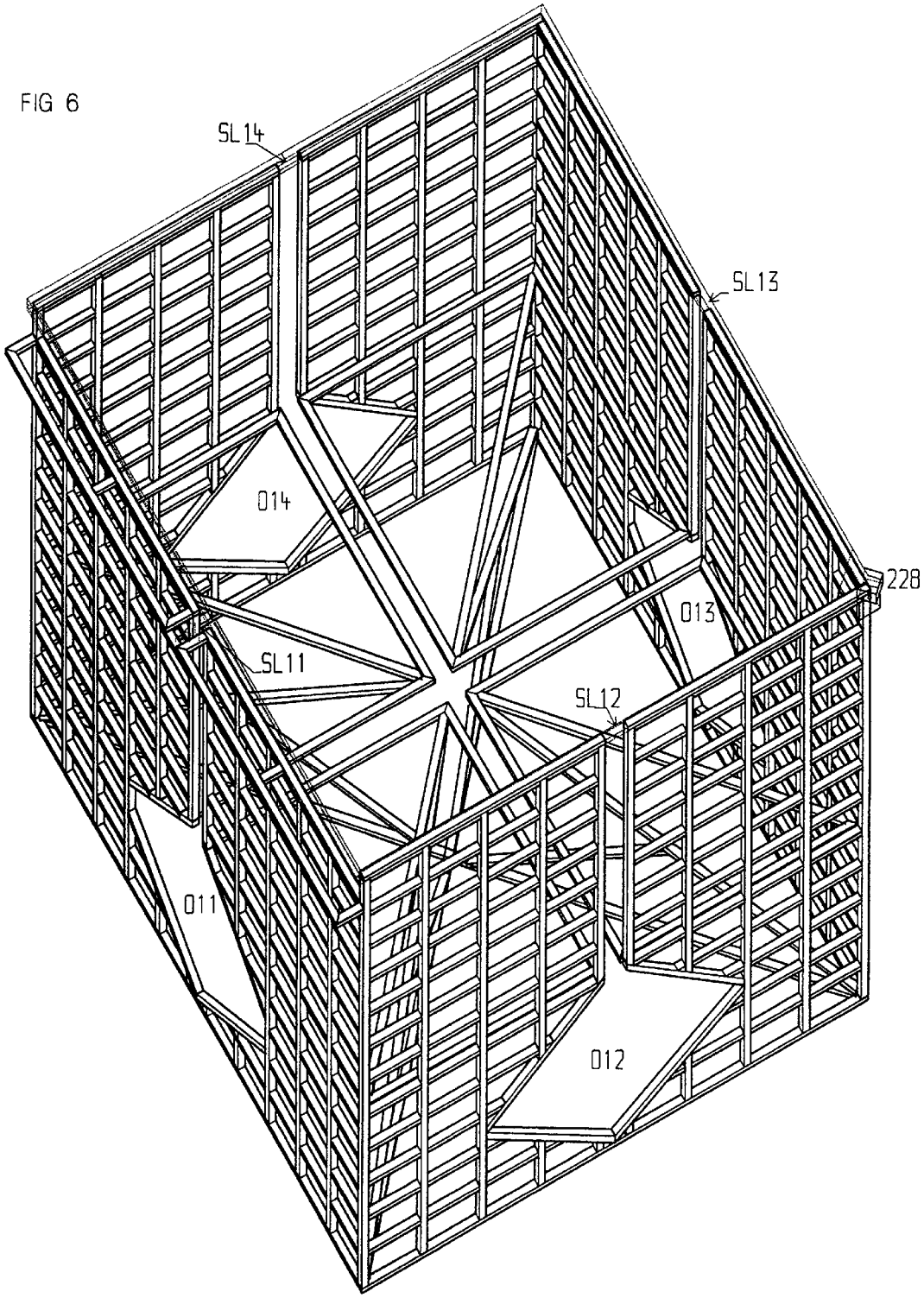
FIG. 6 is a view of the third embodiment shown in FIG. 5 in assembled form.

FIG. 6 is an enlarged axonimetric of the assembled device shown in exploded view of FIG. 5. Openings O11, O12, O13, and O14 as well as Slots SL11, SL12, SL13 and SL14 are shown above their respective openings. The lid with hinge 228 is shown in the closed position and transparent to show the essential structure of the assembled device.

Figure 7:
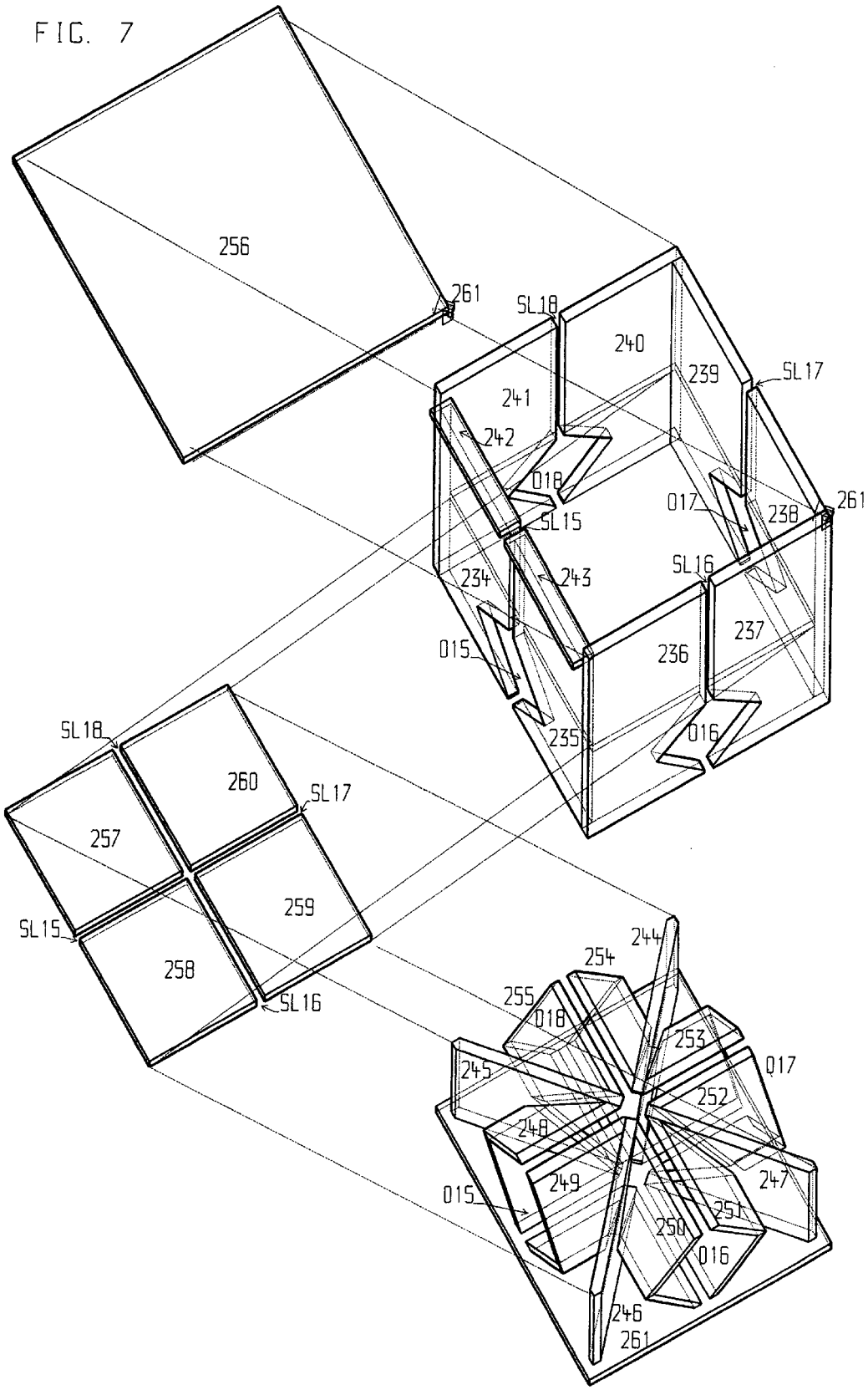
FIG. 7 is an exploded view of a fourth embodiment of the baling and binding container of the present invention.

FIG. 7 is an exploded axonimetric of preferred embodiment 4. Preferred embodiment 4 is a variation of FIG. 1, preferred embodiment 1. Sides 234, 235, 236, 237 238, 239, 240, and 241 serve to contain the paper or flat-stock products above openings O15, O16, O17, and O18 that are themselves contiguous with slots SL15, SL16, SL17 and SL18 respectively. The paper or flatstock products rest on horizontal platform members 257,258,259 and 260 and these in turn are supported along their diagonals by diagonal base supports 245, 246, 247 and 244 respectively which are themselves attached to base 261. FIG. 7 has the addition of sleeves 248,249, 250, 251, 252,253,254,255. These sleeves are geometrically coincide with the openings O15, O16, O17 and O18 as well as the notches in diagonal supports 244,245, 246 and 247. The sleeves supply contiguous passages from opening to opposite opening and the tops of the sleeves are open to coincide with the opening slots of SL15, SL16, SL17 and SL18. The sleeves, openings and slots allow for the passage of the binding medium under and around the paper or flat-stock products that rest on horizontal platform panel 257,258, 259 and 260 when lid 256 is opened at comer hinge 261. Hinge 261 may be eliminated and the invention used with a fitted lid that can be set aside during the binding and baling process and replaced as needed.

Figure 8:
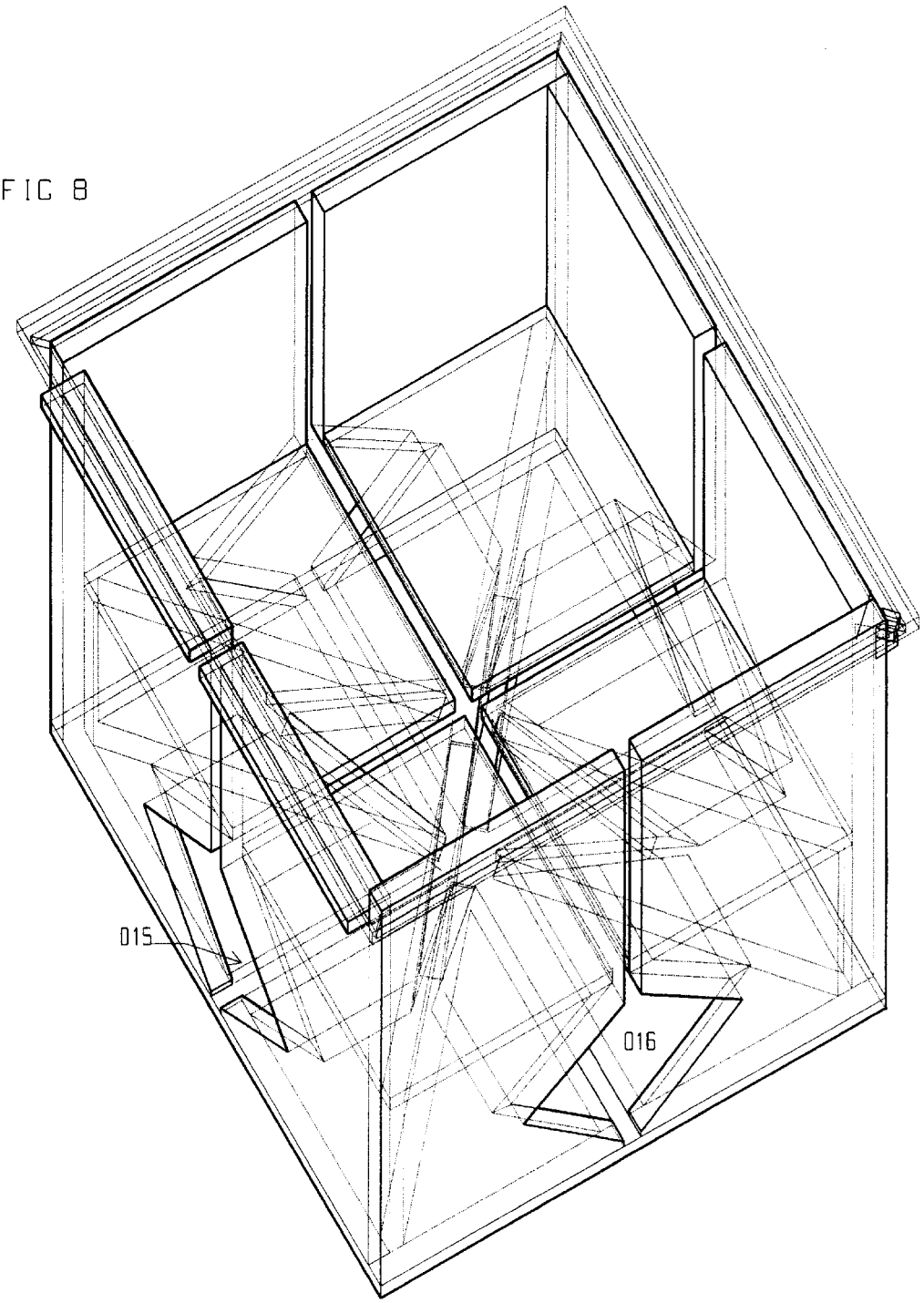
FIG. 8 is a view of the fourth embodiment shown in FIG. 7 in assembled form.

Lowered lips 242 and 243 allow for the introduction of paper or flat-stock products into the device with the lid 256 in the closed position FIG. 8 is an enlarged axonimetric of the assembled device described in FIG. 7 Sheet 7 of 8. The device is shown with only openings O15 and O16 identified for orientation. The device is shown with the comer hinged lid closed and rendered transparent to show the essential structure of the assembled device.

I claim:

1. A container for baling and binding paper or flat-stock products comprising:

a base for supporting the paper products;

a box supported on the base and including first and second side walls and first and second end walls connected together to define an interior which contains the paper or flat-stock products within the box, the base and the box cooperating to support and contain the paper or flat-stock products as a stack;

a lid hingedly connected to the first side wall of the box and movable relative to the box between a first open position in which the box is opened thereby exposing the interior of the box and a second closed position in which the box is covered by the lid, further wherein the second side wall of the box opposite to the first side wall to which the lid is hinged includes a cutout, the lid when in its second closed position cooperating with the cutout in the second side wall to define a slot opening whereby paper or flat-stock products may be fed into the interior of the box without opening the lid; and binding material receiving slots formed through each of the first and second end walls and each of the first and second side walls of the box, a binding material receiving slot formed through the lid, and a plurality of binding material receiving slots formed through the base, whereby binding material may be fed through the slots completely around the paper or flat-stock products stacked within the box so that the paper or flat-stock products may be tied-up into a bundle with the lid in its opened position.

2. The container of claim 1, wherein the base includes an upper platform member on which the paper or flat-stock products are stacked, a plurality of struts for supporting the upper platform member, and a lower support member for supporting the struts, and wherein the box is supported on the lower support member of the base.

3. The container of claim 2, wherein the plurality of slots formed through the base are formed through the upper platform member.

4. The container of claim 3, wherein the plurality of struts each include a cutout, and the cutouts in the struts are cooperatively aligned with the slots in the upper platform member whereby binding material may be fed completely around the paper or flat-stock products stacked within the box.

5. The container of claim 3, wherein the plurality of struts each include a cutout, and further wherein each of the slots in the end walls and side walls of the box include an enlarged opening cooperatively aligned with the cutouts in the struts and cutouts in the lid in the second open position whereby binding material may be fed completely around the paper or flat-stock products stacked within the box so that the paper or flat-stock products may be tied-up into a bundle.

6. The container of claim 2, wherein there are four struts.

7. The container of claim 6, wherein the four struts define an X- shape.

8. The container of claim 1, wherein the slot in the lid separates the lid into first and second lid members each hingedly connected to the first side wall of the box.

9. The container of claim 1, wherein the base, box and lid are each formed from one of the group of materials consisting of wood, plastic, metal, rubber, glass, fiberglass or composite material.

10. A container for baling and binding of paper or flat-stock products comprising:

a base for supporting the paper or flat-stock products, the base including an upper platform member on which the paper or flat-stock products are stacked, a plurality of struts for supporting the upper platform member, and a lower support member for supporting the struts;

a box mounted on the lower support member of the base and including first and second side walls and first and second end walls connected together to define an interior which contains the paper or flat-stock products within the box, the base and the box cooperating to support and contain the paper or flatstock products as a stack;

binding material receiving slots formed through each of the first and second end walls and each of the first and second side walls of the box and a plurality of binding material receiving slots formed through the upper platform member of the base; and wherein the plurality of struts each include a cutout, and the cutouts in the struts are cooperatively aligned with the slots in the upper member of the base and the slots in the first and second end walls and the first and second side walls, whereby binding material may be fed completely around the paper or flat-stock products stacked within the box so that the paper or flat-stock products may be tied-up into a bundle.

11. The container of claim 10, wherein the struts are formed as trusses.

12. The container of claim 10, wherein the struts are formed of solid flat plates.

13. The container of claim 10, wherein the struts include sleeve members connected thereto and cooperative aligned with the cutouts in the struts; and further wherein each of the slots in the end walls and side walls of the box include an enlarged opening cooperatively aligned with the cutouts in the struts and the sleeve members to define a first chute running form the first side wall to the second side wall of the box and a second chute running from the first end wall to the second end wall of the box whereby binding material may be fed through the chutes.

14. The container of claim 10, further comprising a lid connected to the box.

15. The container of claim 14 wherein one of the side walls and one of the end walls meet at a juncture, and further wherein the lid is connected to the box at the juncture by a hinge, the lid moveable relative to the box between a first closed position in which the box is covered by the lid and a second opened position in which the box is opened thereby exposing the interior of the box and allowing unobstructed access to the slots and cutouts.

* * * * *